United States Patent [19]

Copeland

[11] Patent Number: 4,630,185

[45] Date of Patent: Dec. 16, 1986

[54] MECHANICAL ARM WITH TWO LINK MEMBERS

[76] Inventor: Anthony S. Copeland, 220 Lazard Avenue, Montreal, Quebec, Canada, H3R 1N9

[21] Appl. No.: 793,103

[22] Filed: Oct. 30, 1985

[51] Int. Cl.[4] ..... F21M 3/18

[52] U.S. Cl. ..... 362/427; 362/33; 362/269; 362/396; 362/419

[58] Field of Search ..... 362/427, 33, 269, 285, 362/287, 396, 804, 382, 418–419; 403/205, 223; 248/916

[56] References Cited

U.S. PATENT DOCUMENTS

| | | | |
|---|---|---|---|
| 3,291,977 | 12/1966 | Nafe | 362/430 |
| 4,109,144 | 8/1978 | Vidmar | 362/427 |
| 4,208,037 | 6/1980 | LeGal | 403/223 |
| 4,437,144 | 3/1984 | Guenther | 362/804 |

FOREIGN PATENT DOCUMENTS

| | | | |
|---|---|---|---|
| 1297856 | 5/1962 | France | 362/427 |
| 484498 | 9/1953 | Italy | 403/223 |
| 64353 | 1/1942 | Norway | 362/427 |
| 642935 | 9/1950 | United Kingdom | 362/427 |
| 727941 | 4/1955 | United Kingdom | 362/427 |

*Primary Examiner*—E. Rollins Cross

*Attorney, Agent, or Firm*—Fetherstonhaugh & Co.

[57] ABSTRACT

A mechanical arm has a free end that can be positioned in an almost infinite number of locations relative to a fixed end. The mechanical arm may be used as a free position lamp. The arm is free standing in the location without the use of counter balance or springs. The arm comprises a fixed end base and a free end portion with a pair of spaced apart separate link members therebetween, each link member is substantially the same and each has a first goose neck portion with a rotatable connection to the fixed base, a first rigid rod between the first goose neck portion and a second goose neck portion and a second rigid rod between the second goose neck portion and a rotatable connection to the free end portion, a first flexible spacer between the first rigid rods in the pair of link members and a second flexible spacer between the second rigid rods in the pair of link members.

12 Claims, 22 Drawing Figures

MECHANICAL ARM WITH TWO LINK MEMBERS

The present invention relates to a mechanical arm with a free end that can be positioned in an almost infinite number of locations relative to a fixed end, and is free standing in that position. More specifically, the present invention discloses a free position lamp with a pair of spaced apart link members extending from a fixed stand.

Mechanical arms which have free position ends are used for lights, dentists' tools and many other devices. In general, these type of mechanical arms have a solid base which rests on a flat surface or a clamp to allow the fixed end to be held firmly in place. Some form of movable mechanism links the fixed end with a head or free end which can be a lamp, dentist's drill or other item. One example of such a mechanism is that known as a "Luxor" lamp which has a lamp head at the end of two separate arms linked together and utilizing a series of springs to counter balance the arms such that the lamp head can be located in a variety of positions.

The present invention is directed to a mechanical arm suitable for a free position lamp which avoids the necessity of having to have springs and the like to counter balance the arm and has two simple spaced apart rigid link members with flexible goose neck portions between the rigid link members and flexible spacers to support the rigid link members and provide a certain tension or torsion between the members so that a free end, which may be a lamp head, remains in any position it is placed.

The present invention provides a mechanical arm comprising a fixed end base and a free end portion with a pair of spaced apart separate link members therebetween, each link member being substantially the same and each having a first goose neck portion with a rotatable connection to the fixed end base, a first rigid rod between the first goose neck portion and a second goose neck portion, and a second rigid rod between the second goose neck portion and a rotatable connection to the free end portion, a first flexible spacer between the first rigid rods in the pair of link members and a second flexible spacer between the second rigid rods in the pair of link members.

In other embodiments, the first and second rigid rods are fixed to and cannot rotate relative to the first and second goose neck portions, and these goose neck portions are adapted to be bent to a free position and remain in that position. In another embodiment, the first rigid rod is substantially the same length as the second rigid rod and the flexible spacers are formed from foam plastic.

The present invention also provides a free position lamp comprising a stand and a lamp head with a pair of spaced apart separate link members therebetween, each link member being substantially the same and each having a first goose neck portion with a rotatable connection to the stand, a first rigid rod between the first goose neck portion and a second goose neck portion, and a second rigid rod between the second goose neck portion and a rotatable connection to the lamp head, the first and second goose neck portions adapted to be bent to a free position and remain in that position, a first flexible spacer between the first rigid rods in the pair of link members and a second flexible spacer between the second rigid rods in the pair of link members.

The lamp head may have a shade/reflector adapted to be swivelled up and down relative to the rotatable connection from the second rigid rod to allow different lighting angles. The stand may have a clamp means to attach the lamp firmly in a fixed location or may be a solid base with sufficient weight to hold the lamp on a flat surface.

In drawings which illustrate embodiments of the invention,

Figure 1:
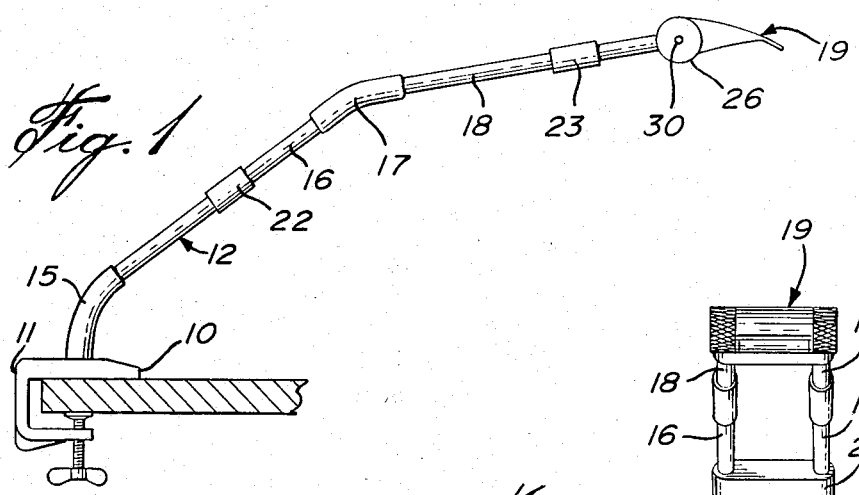
FIG. 1 is a side view of a mechanical arm utilized as a light.
Figure 2:
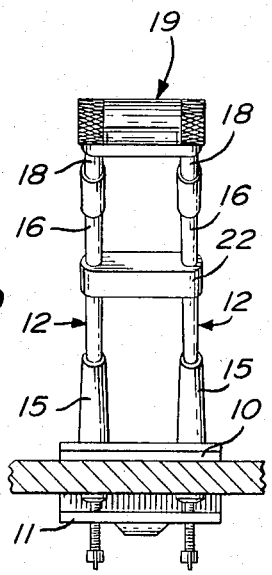
FIG. 2 is a front view of the mechanical arm shown in FIG. 1.
Figure 3:
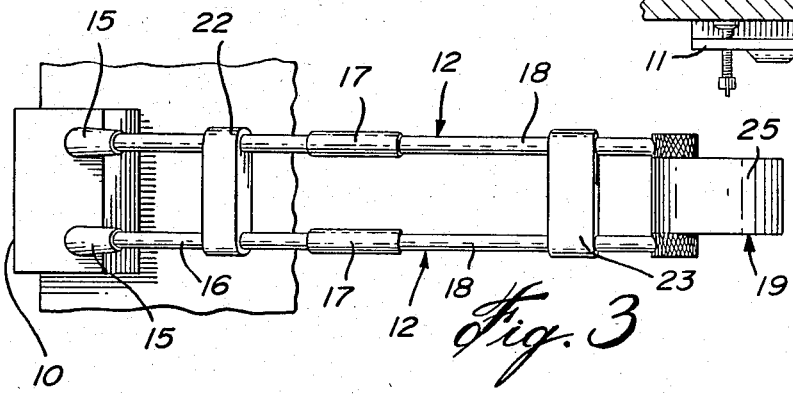
FIG. 3 is a top view of the mechanical arm shown in FIG. 1.
Figure 4:
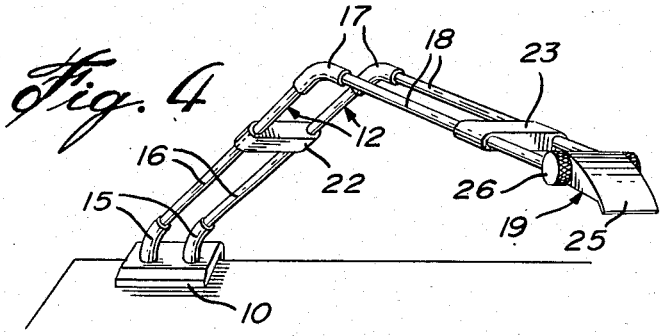
FIG. 4 is an isometric view of the mechanical arm shown in FIG. 1.
Figure 5:
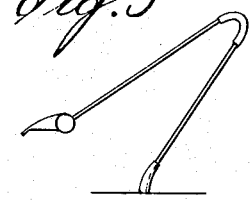
FIGS. 5 to 12 are side views of the mechanical arm in a variety of different positions.
Figure 6:
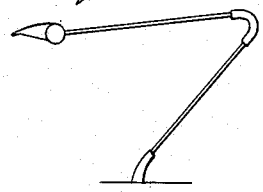
Figure 7:
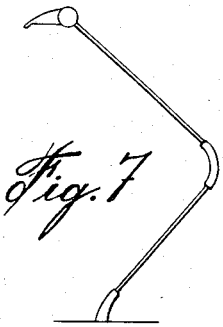
Figure 8:
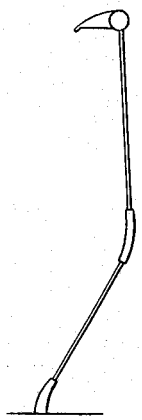
Figure 9:
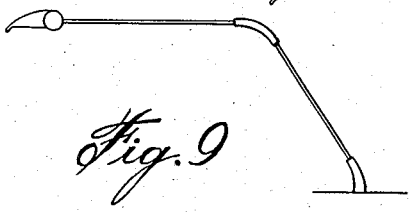
Figure 10:
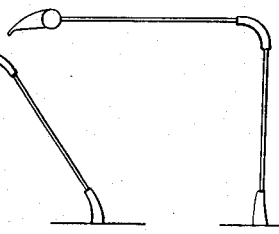
Figure 11:
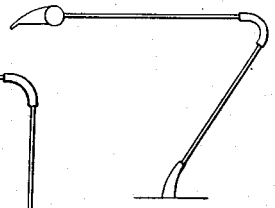
Figure 12:
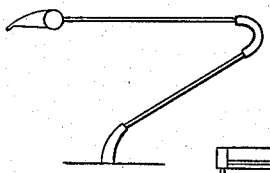
Figure 13:
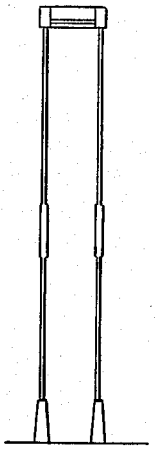
FIGS. 13 to 20 are front views of the mechanical arm in a variety of different positions.
Figure 14:
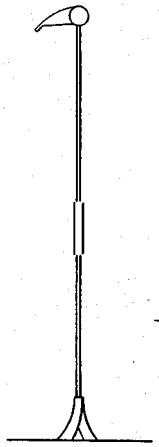
Figure 15:
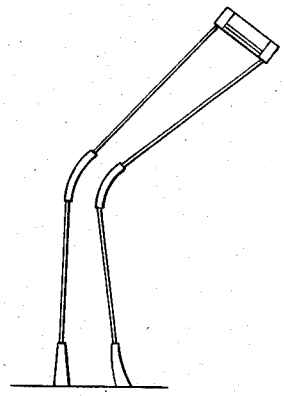
Figure 16:
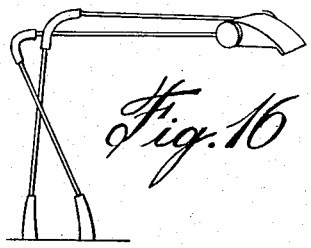
Figure 17:
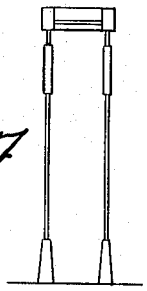
Figure 18:
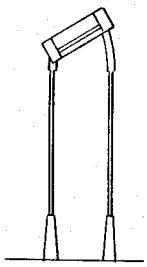
Figure 19:
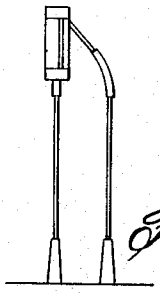
Figure 20:
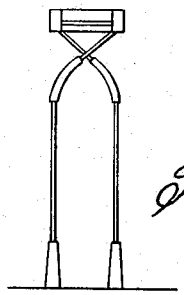

Referring now to the drawings, a mechanical arm in the form of a light has a base 10 which, as shown in FIG. 1, has a clamp 11 to hold the base 10 to a table top or the like. Whereas the base is shown as being clamped, it may be a solid heavy stand having sufficient weight and contact area to hold the lamp or mechanical arm without necessitating a clamp 11. Two spaced apart link members 12 are provided, each having a first goose neck portion 15 which is rotatably mounted to the base 10. Thus the first goose neck portion 15 can be rotated axially in its mounting on the base plate 10.

The goose neck portion 15 for each link member 12 is able to be bent in all directions. Rigidly attached to the top of the goose neck portion 15 is a first rigid rod 16, preferably formed from a metal rod and being somewhat flexible, but unlike the goose neck portion 15, this rigid rod 16 is a tension rod and after flexing returns to its original shape when released. A second goose neck portion 17 is rigidly attached to the end of the first rigid rod 16 and forms a flexible link to a second rigid rod 18. This second rigid rod 18 is made of similar material to the first rigid rod and extends to a free end portion 19 which in the drawings is illustrated as a lamp head. The second or top rigid rod 18 is able to swivel or rotate at the connection where it joins to the free end portion or lamp head 19. A first flexible spacer 22 extends across the two first rods 16 at about their mid position and a second flexible spacer 23 extends across the two top rods 18. These flexible spacers are preferably made from a plastic foam and while generally holding the rods apart they are able to be compressed when the rods are twisted but apply a tension or torsion to the rods. The flexible spacers allow one rod to move relative to the other so that the rods can be twisted in either direction relative to the other and retain a twisted position.

The lamp head 19 has a shade/reflector 25 bending out from a cylindrical portion 26. The cylindrical portion may swivel about its axis so that the lamp can be arranged to shine downward at different angles. A light bulb 30 is located within the cylindrical portion 26 at the swivel axis and is arranged not to swivel with the shade/reflector, the type of light bulb being dependent upon the light requirements of the lamp. Whereas one embodiment of lamp head is shown and described, it will be understood that many different arrangements of lamp head may be adapted to the free end of the mechanical arm.

The lamp head 19 can be moved up or down and in this case, the first goose neck portions 15 and the second goose neck portions 17 bend to the required angle and the goose neck portions then retain the shape that they are set in so that the lamp head remains in the set position. Furthermore, the lamp head can be twisted in any number of directions and this twisting causes tension in the rigid rods 16 and 18. The tension is partly countered by the flexible spacers 22 and 23 to hold the lamp head in any desired position. It has been found that by utilizing two link members 12 rather than one, the flexibility of movement and the ability for the lamp head to be left in a desired position is considerably better than utilizing only a single link member.

Different arrangements of rod lengths and goose neck portions may be provided dependent upon the requirement of the mechanical arm. As shown in the drawings, the first rigid rods 16 and the second rigid rods 18 are substantially the same length. The rods are preferably steel rods which have a certain flexibility.

The mechanical arm has a fluid movement so that the free end can be positioned in an almost infinite number of locations relative to the fixed end. FIGS. 4 to 8 illustrate the first rigid rods substantially in the same position with the second rigid rods in different positions. FIGS. 9 to 12 show the second rigid rods in a substantially horizontal plane with the first rigid rods at a number of different angles. FIGS. 13 to 16 illustrate the ability of the two link members to break their parallel relationship either by twisting, turning or both. FIGS. 17 to 20 shows the free end in the form of a lamp head can rotate at least 180° in either direction.

Figure 21:
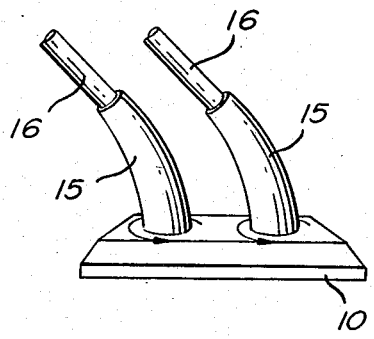
FIG. 21 is a partial isometric view of the fixed end base of the mechanical arm.
Figure 22:
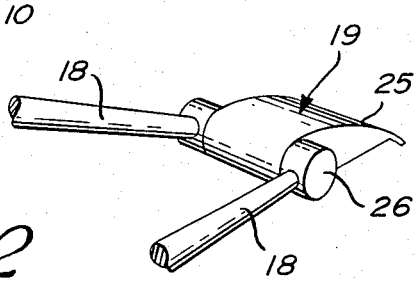
FIG. 22 is a partial isometric view of the free end of the mechanical arm.

Details of the fixed end and the free end of the mechanical arm are illustrated in FIGS. 21 and 22. The first goose necks 15 have a swivel connection to the base 10 and the second rigid rods 18 swivel at the connection to the free end of the arm.

In one embodiment, a special coating is put on the rods and each rod is used as a lead connector to the light bulb 30, thus no wires need be used to the light bulb.

The dimensions of the mechanical arm are partially determined by the weight of the lamp head or free end device that has to be supported. The strength of the goose neck portion is such that it can support the weight of the rods plus the free end portion in any position. In one embodiment, it is feasible to have more than two rod sections in each of the link members 12 and indeed another goose neck portion may be added at the top of the second rod section with an additional rod extending beyond the goose neck portion. This could apply to both link members. In some embodiments, the rod portions may be tubes to allow an electrical lead to be run up at least one of the tubes. The mechanical arm can be scaled up to much larger and longer lengths than would be needed for a lamp depending on the use to which the mechanical arm is to be put. A scale up would require stronger goose neck portions and probably stronger rods which as previously stated, may be in the form of tubes. If a lightweight unit is required, then possibly the metal tube or rod may be replaced by wooden sections or even plastic sections.

Various changes may be made to the embodiments shown and described herein without departing from the scope of the present invention which is limited only by the following claims.

The embodiments of the invention in which an exclusive property or privilege is claimed are defined as follows:

1. A mechanical arm comprising a fixed end base and a free end portion with a pair of spaced apart separate link members therebetween, each link member being substantially the same and each having a first goose neck portion with a rotatable connection to the fixed end base, a first rigid rod between the first goose neck portion and a second goose neck portion, and a second rigid rod between the second goose neck portion and a rotatable connection to the free end portion, a first flexible spacer between the first rigid rods in the pair of link members and a second flexible spacer between the second rigid rods in the pair of link members.

2. The mechanical arm according to claim 1 wherein the first and second rigid rods are affixed to and cannot rotate relative to the first and second goose neck portions.

3. The mechanical arm according to claim 1 wherein the first and second goose neck portions are adapted to be bent to a free position and remain in that position.

4. The mechanical arm according to claim 1 wherein the first rigid rod is substantially the same length as the second rigid rod.

5. The mechanical arm according to claim 1 wherein the first and second flexible spacers are formed from foam plastic.

6. A free position lamp comprising a stand and a lamp head with a pair of spaced apart separate link members therebetween, each link member being substantially the same and each having a first goose neck portion with a rotatable connection to the stand, a first rigid rod between the first goose neck portion and a second goose neck portion, and a second rigid rod between the second goose neck portion and a rotatable connection to the lamp head, the first and second goose neck portions adapted to be bent to a free position and remain in that position, a first flexible spacer between the first rigid rods in the pair of link members and a second flexible spacer between the second rigid rods in the pair of link members.

7. The lamp according to claim 6 wherein the lamp head has a shade/reflector adapted to be swivelled up and down relative to the rotatable connection from the second rigid rod to allow different lighting angles.

8. The lamp according to claim 7 wherein the first and second rigid rods are fixed to and cannot rotate relative to the first and second goose neck portions.

9. The lamp according to claim 6 wherein the stand has a clamp means to attach the lamp firmly in a fixed location.

10. The lamp according to claim 7 wherein the first and second rigid rods are all substantially the same length.

11. The lamp according to claim 6 wherein the rigid rods are formed of metal and the flexible spacers are formed from foam plastic.

12. The lamp according to claim 6 wherein an electric bulb is located in the lamp head and electrical leads to the bulb are integral with the pair of link members.

* * * * *